US006694673B2

(12) United States Patent
Savard et al.

(10) Patent No.: US 6,694,673 B2
(45) Date of Patent: Feb. 24, 2004

(54) ECCENTRICALLY MOUNTABLE PLUG FOR COUNTERBALANCING SYSTEMS OF GARAGE DOORS AND THE LIKE

(75) Inventors: Normand Savard, Drummondville (CA); Michel Beaudoin, Drummondville (CA); Pierre-Louis Foucault, St-Lambert (CA); Luc Bourassa, St-Majorique (CA); Dominic Charpentier, St-Nicéphore (CA)

(73) Assignee: Canimex Inc., Drummondville (CA)

( * ) Notice: Subject to any disclaimer, the term of this patent is extended or adjusted under 35 U.S.C. 154(b) by 0 days.

(21) Appl. No.: 09/841,642

(22) Filed: Apr. 24, 2001

(65) Prior Publication Data

US 2001/0039761 A1 Nov. 15, 2001

(30) Foreign Application Priority Data

Apr. 25, 2000 (CA) ..... 2306610

(51) Int. Cl.[7] ..... E05F 15/16
(52) U.S. Cl. ..... 49/200; 49/199; 160/191
(58) Field of Search ..... 49/199, 200; 160/191, 160/192

(56) References Cited

U.S. PATENT DOCUMENTS 3,685,567 A * 8/1972 Pemberton et al. ..... 160/191
4,504,252 A * 3/1985 Honma ..... 474/112
5,865,235 A * 2/1999 Krupke et al. ..... 160/191
5,996,670 A * 12/1999 Igarashi ..... 160/133
6,089,304 A * 7/2000 Mullet et al. ..... 160/193
6,149,542 A * 11/2000 Lehtovaara ..... 29/888.01
6,174,575 B1 * 1/2001 Foucault et al. ..... 16/DIG. 7
6,263,541 B1 * 7/2001 Scates ..... 16/197

* cited by examiner

*Primary Examiner*—Gregory J. Strimbu

(57) ABSTRACT

A plug for use in a counterbalancing mechanism of a cable-operated door. The plug is used for operatively connecting an overhead shaft to a torsion spring co-axially mounted thereon. The plug includes a cylindrical collar and a cylindrical flange. The cylindrical collar has opposite first and second portions and is provided with a hooking slot for hooking a free end of the torsion spring thereon, and the torsion spring having a segment coaxially mounted about the first portion of the collar. The cylindrical flange is rigidly affixed to the second portion of the collar and is used for transferring a torque between the torsion spring and the overhead shaft when the flange is securely fixed about the overhead shaft. The plug is characterized in that the collar is eccentrically mounted about the overhead shaft, thereby allowing the plug to be used when the radial space between the plug and the overhead shaft is limited and also preventing the overhead shaft from being damaged by the free end of the torsion spring.

15 Claims, 6 Drawing Sheets

ECCENTRICALLY MOUNTABLE PLUG FOR COUNTERBALANCING SYSTEMS OF GARAGE DOORS AND THE LIKE

FIELD OF THE INVENTION

The present invention relates to a plug, also known as a "collar" or an "anchor", such as the ones used for operatively connecting torsion springs to overhead shafts of counterbalancing mechanisms used for garage doors and the like, in order to allow a torque transfer between the torsion spring and the overhead shaft so as to counterbalance such cable-operated doors.

BACKGROUND OF THE INVENTION

It is known in the art that large, vertical, cable-operated doors, such as commercial and residential sectional garage doors, usually require counterbalancing mechanisms to counterbalance the weight of the door in order to decrease the force required to open the door and also facilitate its closing from a raised to a lowered position. Large sectional garage doors used in commercial and residential applications may be manually or power operated. In either case, but particularly for manually operated doors, counterbalancing mechanisms have been used for many years to counterbalance the weight of the door and control its opening and closing movements so that one person can easily control the operation of the door. Counterbalancing mechanisms are also advantageous for power operated overhead doors since they reduce the power requirements needed for the motor and they lower the structural strength required for the door opening and closing mechanism. In other words, lighter weight, lower cost, door controlling mechanisms may be used if a counterbalancing mechanism is connected to the door to assist it in its opening and closing movements. Furthermore, the provision of a counterbalancing mechanism minimizes the chance of a rapid and uncontrolled closing of the door in the event of a failure of the door opening and closing mechanism, which can result in serious injury or damage.

It is also known in the art that a widely used type of counterbalancing mechanism generally comprises a pair of spaced apart cable drums connected to flexible cables, each cable being in turn connected to a lower opposite side edge of the garage door. The cable drums are usually mounted on a overhead shaft which is supported above the door opening and is connected to one or more torsion springs which are each fixed to the shaft at one end, and secured to a fixed structure such as the wall for example at the other end, so that the cable drums are biased to rotate in a direction which winds the cables onto the drums and counteracts the weight of the door connected to the cables. The torsion springs are adjusted to properly balance the weight of the door so that minimal opening and closing efforts are required, either manually or when motor controlled.

It is also known in the art that conventional, low cost adjustment devices used for the above-mentioned type of counterbalance mechanism, and widely utilized in the garage door industry, are generally cylindrical "collars" commonly referred to also as "plugs" (or "cones") which are connected to the so-called fixed ends of the torsion springs and are thus mounted on the aforementioned shaft for adjusting the deflection of the springs to preset the counterbalance force. The aforementioned collars usually include one or more setscrews which lock the collars to the shaft to prevent rotation thereabout except during normal adjustment of the spring deflection. The collars also usually include sockets for receiving winding bars whereby the springs are manually preset, or "preloaded", by rotating the collars with respect to the shaft using the winding bars and then locking the collars to the shaft with the setscrews. Each collar also may include a slot onto which a corresponding free end of the torsion spring is hooked on. These slots are usually T-shaped, and are thus commonly known as "T-slots".

An important problem associated with the aforementioned type of counterbalancing mechanism, or with any other type of counterbalancing mechanism which uses winding collars (also known as "anchors") having T-slots and tensioning springs, arises when the radial space between the inside of the collar and the outside of the shaft is limited. Given the fact that most overhead shafts employed in the industry are usually of standard diameter, the above-mentioned problem generally arises either when the shaft is covered with an additional fitting placed thereabout, or when the torsion spring mounted about the shaft (which may or may not be covered with an additional fitting) has a reduced inside diameter. In the first case, when the radial space between the shaft and the torsion spring is limited as a result of a shaft being covered with an additional fitting so as to protect the shaft and/or transfer the load, collars having larger inside diameters are required to be able to mount them onto the fitting-covered shaft. Not only are large inside diameter collars more expensive, but they need to be used with torsion springs having larger inside diameters in order to render the counterbalancing mechanism operable. Torsion springs having large inside diameters (i.e. greater than 2") are also more expensive and are limited in choice, that is, they are not readily available because most of the torsion springs being used in the industry have generally an inside diameter of equal to or less than 2". Now, in the second case, that is, when the radial space between the shaft and the torsion spring is limited as a result of using torsion springs having reduced inside diameters, the free ends of such springs hooked onto the plugs do not allow the latter to be mounted about the overhead shafts. There is simply not enough clearance between the shaft and the collar for a spring's free end (also known as a "spring tail") to be lodged thereinbetween, and as a result, the collars simply do not fit onto the overhead shaft. Furthermore, if the radial distance between the overhead shaft and the collar is limited, the spring tail may not be property hooked onto the collar which might in turn render the counterbalancing inoperable and/or unsafe and may also lead to the spring tail damaging the outer surface of the overhead shaft which is also undesirable for reasons well known in the art. The above-described problems are inherent to the collars known in the art which are inadequate for those cases where the space between the inside of the plug and the shaft (which may or may not be covered with an additional fitting) is small.

Another major problem is that none of the types of collars known in the art provide a simple, quick, reliable, and cost effective way for operatively connecting a torsion spring having a reduced inside diameter to an overhead shaft of a counterbalancing mechanism used for garage doors and the like.

Hence, there is a need for a more compact, more reliable, easier to use, easier to maintain, safer, quicker, and more cost effective device for operatively connecting torsion springs to overhead shafts of counterbalancing systems used for cable-operated doors, such as garage doors for example, particularly for when the space between the inside of the plug and the shaft (which may or may not be covered with any additional fitting) is limitedly small.

SUMMARY OF THE INVENTION

The object of the present invention is to provide a "plug", also known as a "collar", an "anchor", or a "cone", which satisfies some of the above-mentioned needs and is thus an improvement over the devices known in the prior art.

More particularly, the object of the present invention is to provide a new approach for operatively connecting torsion springs to overhead shafts of counterbalancing systems used for garage doors and the like.

In accordance with the present invention, the above object is achieved with a plug for use in a counterbalancing mechanism of a cable-operated door, said plug being used for operatively connecting an overhead shaft to a torsion spring co-axially mounted onto said shaft, said plug comprising:

- a cylindrical collar having opposite first and second portions, the first portion being used for receiving a coiled segment of the torsional spring, the collar being provided with a hooking slot positioned between the first portion and the second portion of the collar for hooking a free end of the torsion spring onto said hooking slot; and
- a cylindrical flange rigidly affixed to the second portion of the collar, said flange being used for transferring a torque between the torsion spring and the overhead shaft when the flange is securely fixed about the overhead shaft;
- wherein the collar of the plug is eccentrically mountable about the overhead shaft so as to allow a portion of the free end of the torsion spring to be lodged between the collar and the overhead shaft.

The objects, advantages and other features of the present invention will become more apparent upon reading of the following non-restrictive description of a preferred embodiment thereof, given for the purpose of exemplification only with reference to the accompanying drawings.

DETAILED DESCRIPTION OF A PREFERRED EMBODIMENT OF THE INVENTION

Figure 5:
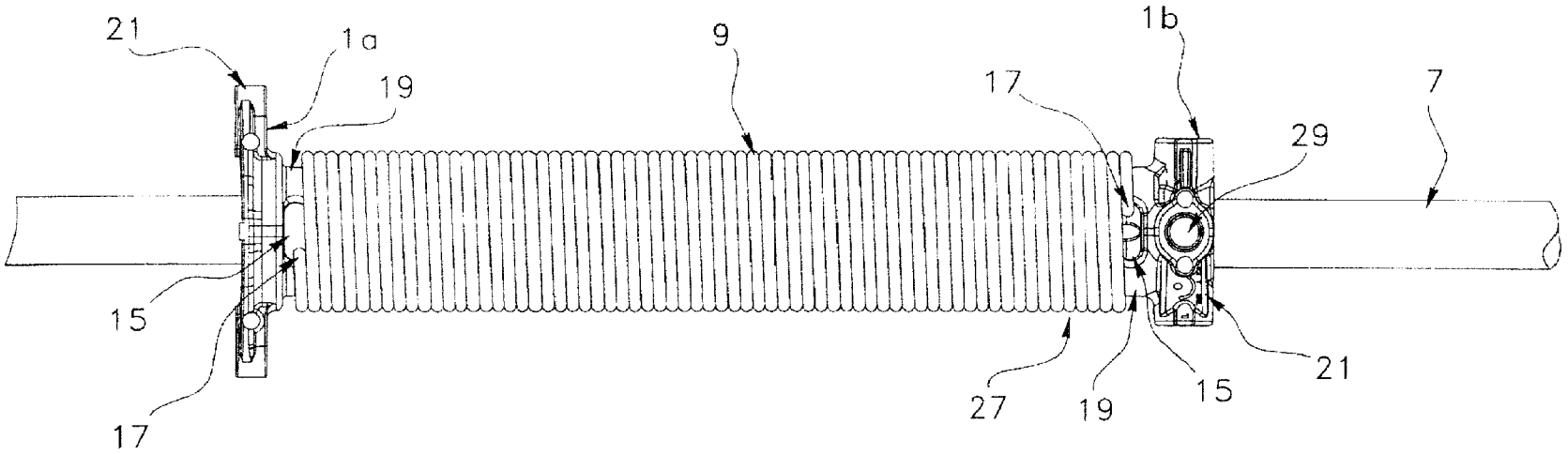
FIG. 5 is a side view of a stationary plug and a winding plug according to preferred embodiments of the invention, said stationary and winding plugs being eccentrically mounted about the overhead shaft and each plug cooperating with a free end of the torsion spring.
Figure 6:
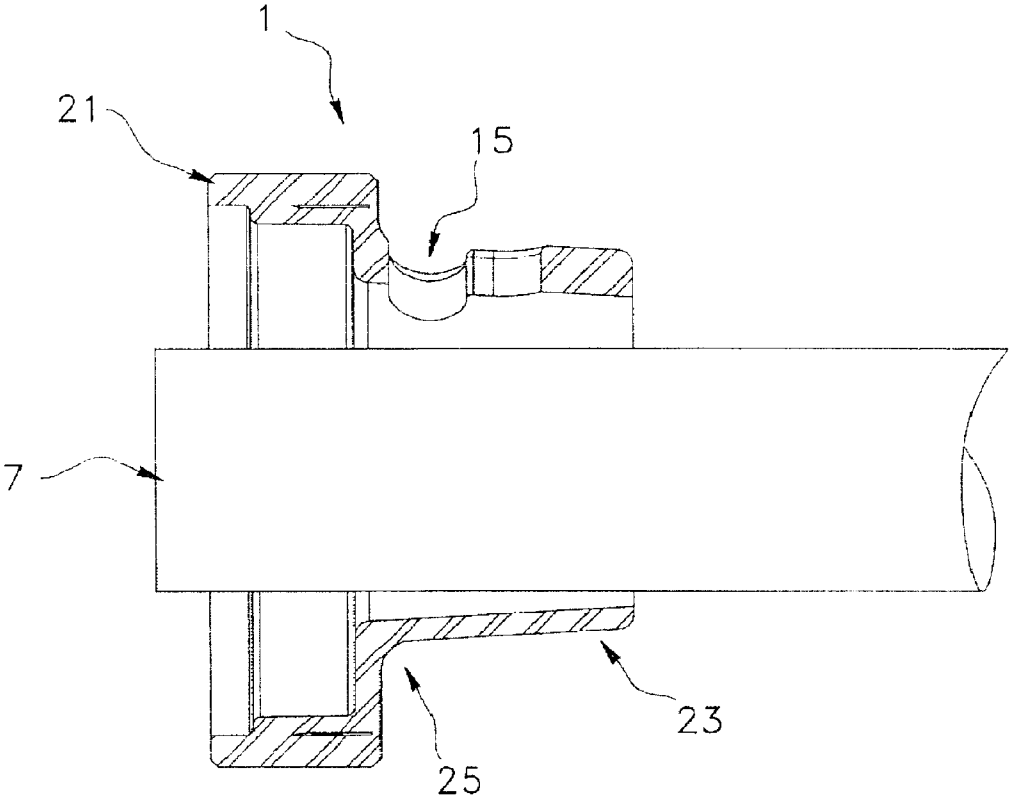
FIG. 6 is a partial sectional side view of the stationary plug shown in FIG. 5, said stationary plug being eccentrically mounted about the overhead shaft.
Figure 7:
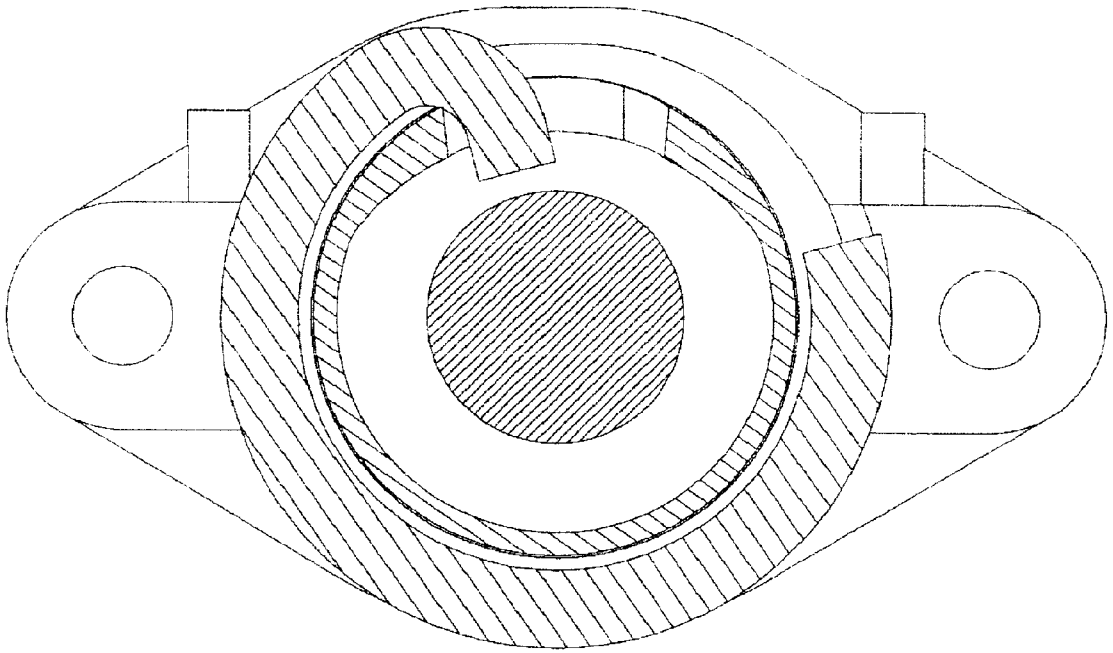
FIG. 7 is a sectional top view of the stationary plug shown in FIG. 6, said stationary plug being eccentrically mounted about the overhead shaft and being shown cooperating with a free end of the torsion spring.

In the following description, the same numerical references refer to similar elements. The embodiments shown in FIGS. 5–7 are preferred. In the context of the present description, the expressions "plug", "collar", "anchor", and any other equivalent expression known in the art (such as "cone" for example) used to designate those structures employed to operatively connect torsion springs onto overhead shafts of counterbalancing mechanisms used for garage doors and the like will be used interchangeably. Furthermore, although the present invention was primarily designed for a counterbalancing mechanism of a garage door, it may be used for counterbalancing mechanisms of other kinds of doors, such as slidable truck doors, or with any other items suspended by a cable, as apparent to a person skilled in the art. For this reason, the expression "garage door" should not be taken as to limit the scope of the present invention and includes all other kinds of doors or items with which the present invention may be useful. Hence, also in the context of the present invention, the expressions "garage door" and "cable-operated door" will be used interchangeably as well.

The plug 1 according to the preferred embodiment of the invention as it is illustrated with accompanying drawings is a plug 1 for use in counterbalancing mechanisms 3 of garage doors 5 and the like. The plug 1, also known as a "collar", an "anchor", and/or a "cone", as aforementioned, is used to operatively connect an overhead shaft 7 to a torsion spring 9 coaxially/concentrically mounted onto the overhead shaft 7.

Figure 1:
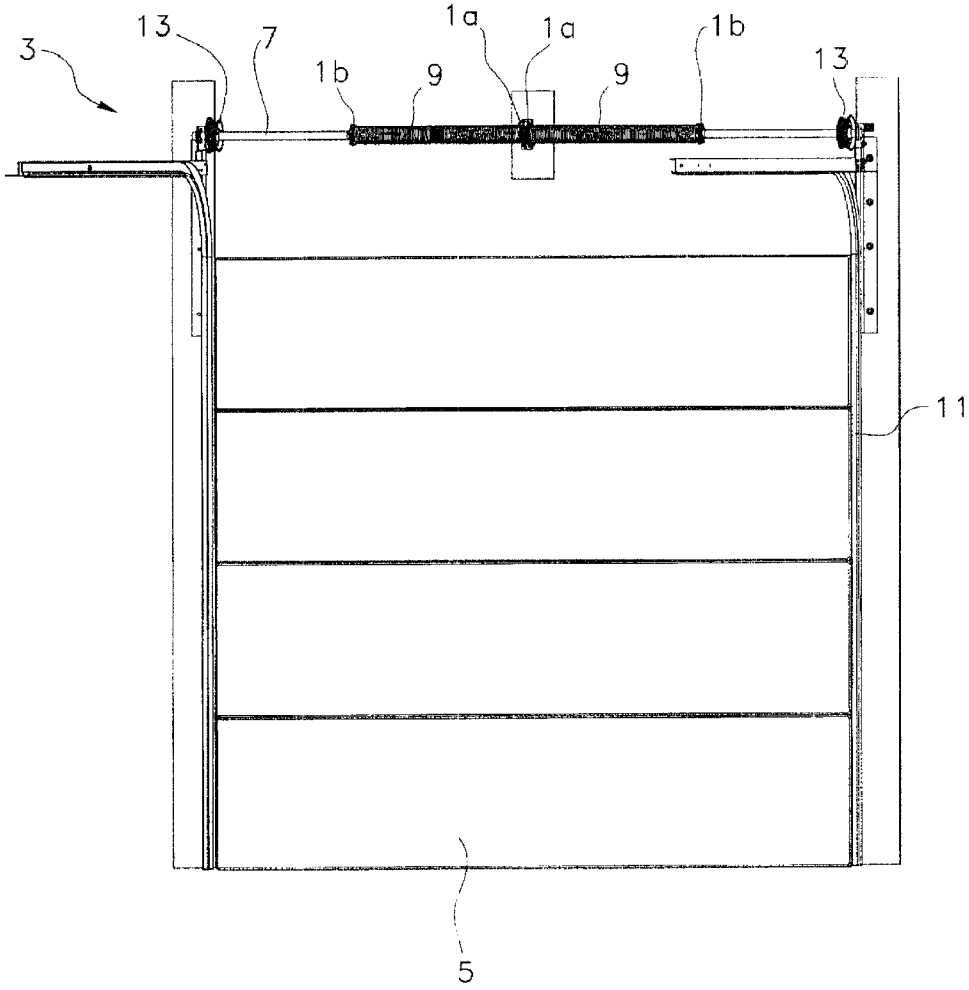
FIG. 1 (PRIOR ART)
FIG. 1 is a perspective view of a sectional garage door connected to a counterbalancing mechanism provided with stationary and winding plugs according to the prior art.

Referring to FIG. 1, most cable-operated garage doors 5, whether manually or power operated, are connected to an overhead counterbalancing mechanism 3 that provides a counterbalancing force in order to decrease the force required to open the door 5 and also facilitate its closing. The garage door 5 is usually connected to the counterbalancing mechanism 3 by means of two cables 11, one at the right and one at the left (not shown) The cables 11 are usually made of steel and the lower free end of each cable is usually attached at the bottom of the door 5. As illustrated in FIG. 1, each cable 11 cooperates with a corresponding cable drum 13 which is mounted to the overhead shaft 7 in order to facilitate raising and lowing of the cable-operated door 5. Torque is transferred between the torsion spring 9 and the overhead shaft 7 by means of plugs 1 which operatively connect the shaft 7 to the spring 9 in order to counterbalance the weight of the garage door 5. Usually, each torsion spring 9 is fixed to the overhead shaft 7 at one end, by means of a plug 1 known as a "winding plug" 1*b,* and operatively secured to the wall at the other end, by means of another plug 1 known as a "stationary plug" 1*a*. The above-mentioned types of counterbalancing mechanisms 3 can be found in other types of cable-operated doors 5, such as slidable truck doors for example.

Figure 3:
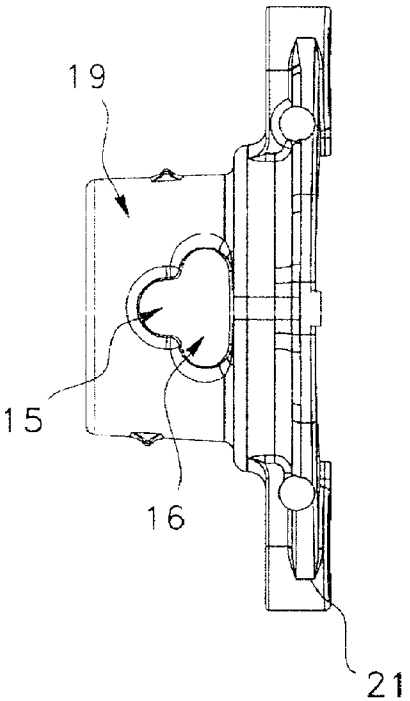
FIG. 3 (PRIOR ART)
FIG. 3 is a side plan view of the stationary plug shown in FIG. 2.
Figure 2:
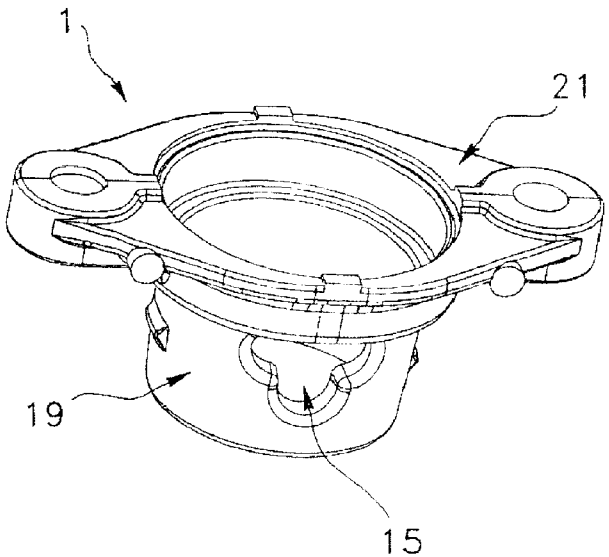
FIG. 2 (PRIOR ART)
FIG. 2 is a perspective view of one of the stationary plugs shown in FIG. 1.
Figure 4:
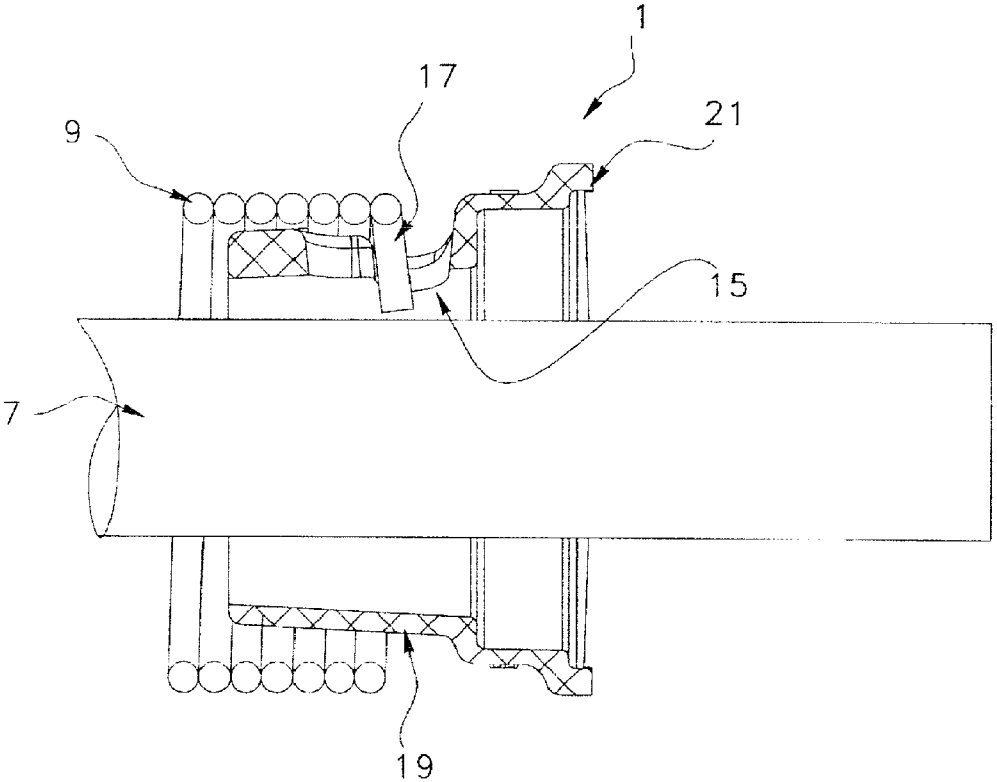
FIG. 4 (PRIOR ART)
FIG. 4 is a partial sectional side view of the stationary plug shown in FIG. 2, said stationary plug being shown concentrically mounted about an overhead shaft and cooperating with a free end of a torsion spring.

Referring now to FIGS. 2 to 4, an example of a typical anchor slot plug 1, also known as a cone, as already known in the prior art, is shown. The form of the slot 15 allows the introduction of the free end 17 of the spring 9, also known as a "spring tail", without the use of any tool. Once the tail is introduced into the entry section of the collar slot 15, the collar 19 is rotated in the spring axis. The collar 19 is then pushed towards the spring 9 to be placed in the second section of the slot 15, after what it is rotated around the axis to be blocked there by the T-shaped slot section 16. This type of plug 1 is suitable for torsion springs 9 having inside diameters of 2" and more but cause several problems, that is, they do not fit and thus cannot be used with torsion springs 9 having inside diameters of 1.75" and smaller. This last category of springs 9 represents an important market part of the springs 9 being used in the industry of garage door counterbalancing mechanisms 3.

According to the present invention and as better shown in FIGS. 5 and 7, the plug 1, whether it is a stationary plug 1*a* or a winding plug 1*b*, comprises a cylindrical collar 19 and a cylindrical flange 21. The cylindrical collar 19 has opposite first and second portions 23, 25, and is provided with a hooking slot 15 for hooking a free end 17 of the torsion spring 9 onto the plug 1, as better shown in FIG. 5. As also shown in FIG. 5, a segment 27 of the torsion spring 9 is preferably coaxially mounted about the first portion 23 of each collar 19. The cylindrical flange 21 is rigidly affixed to the second portion 25 of the collar 19. Preferably, the collar 19 and the flange 21 are made integral to each other, that is, they are made of one single piece. The cylindrical flange 21 can be securely fixed to the overhead shaft 7 by means of fasteners, such as setscrews for example, so as to allow a proper torque transfer between the torsion spring 9 and the overhead shaft 7. The plug 1 according to the present invention is characterized in that the collar 19 is eccentrically mounted about the overhead shaft 7 so as to allow the free end 17 of the torsion spring 9 to be lodged between the collar 19 and the overhead shaft 7, as better shown in FIG. 7, thereby allowing the plug 1 to be used when the space between the inside of the plug 1 and the shaft 7 is limited, either as a result of the shaft 7 being covered with an additional fitting (not shown) placed thereabout, or as a result of the plug 1 being used with torsion springs 9 having reduced inside diameters (preferably, torsion springs 9 having an inside diameter of 1.75" or smaller which represent a major part of the market), or as a result of both. Indeed, according to the present invention, the collar 19 of the plug 1 is eccentrically positioned with respect to the flange 21. As better shown in FIG. 6, the first and second portions 23, 25 of the collar 19 are offset with respect to the flange 21 which is typically mounted concentrically about the overhead shaft 7. By eccentrically mounting the collar 19 about the overhead shaft 7, more clearance is allowed between the inside of the collar 19 and the shaft 7 so as to properly hook the spring's free end 17 onto the collar 19 and lodge it between the inside of the plug 1 (or the inside of the collar 19 for that matter) and the shaft 7, as better shown in FIG. 7.

According to a preferred embodiment of the invention and as better shown in FIG. 5, each torsion spring 9 is preferably coaxially mounted onto the overhead shaft 7 and is preferably connected with a stationary plug 1*a* at one end 17, and a winding plug 1*b* at the other end 17. The stationary plug 1*a* is preferably connected to a fixed structure, such as for example, a bracket rigidly mounted to a wall. The winding plug 1*b* is removably fixed to the overhead shaft 7 and is used to operatively connect the torsion spring 9 to the overhead shaft 7 so as to allow a torque transfer between the latter two. Preferably, the flange 21 of the winding plug 1*b* is provided with sockets 29 for receiving winding bars in order to manually preset a given torque onto the torsion spring 9, prior to securing the winding plug 1*b* onto the overhead shaft 7, by rotating the winding plug 1*b* with respect to the overhead shaft 7. Once an appropriate amount of torque ("preload") has been applied to the torsion spring 9 in order to allow an appropriate counterbalancing force as apparent to a person skilled in the art, the winding plug 1*b* is secured to the shaft by means of setscrews provided for that purpose in order to prevent any substantial rotational relative movement between the winding plug 1*b* and the shaft 7. In order to assure a good torque transfer between the torsion spring 9 and the overhead shaft 7. Preferably, the winding plug 1*b* may allow an appropriate relative sliding of the corresponding spring end 17 attached thereon so as to compensate for the contraction or extension of the spring 9 in function of the compression torque. The plugs 1, whether stationary or winding, can be easily removed from the overhead shaft 7, for easier maintenance and/or repair of the counterbalancing mechanism 3, and more specifically for spring replacement, by unfastening the setscrews and/or unhooking the free ends 17 of the torsion springs 9, or by any other appropriately safe manner, as apparent to a person skilled in the art.

As better shown in FIGS. 6 and 7, the present invention is characterized in that the collar 19 of the plug I is eccentrically mounted about the overhead shaft 7. In doing so, the slot part is moved off the collar axis to allow reducing of collar diameter, in order to be able to use the plug 1 according to the present invention with torsion springs 9 of reduced inside diameters, preferably equal to or less than 2". Furthermore, by eccentrically mounting the plug 1 about the overhead shaft 7, the plug 1 can also be used and thus mounted onto a shaft 7 covered with an additional fitting (not shown), which could be used for protecting the shaft's surface and/or for transferring the load, so as to allow the spring's free end 17 to be hooked onto the collar's slot 15 and lodged between the inside of the collar 19 and the fitting. As better shown in FIG. 7, the aforementioned geometry, that is, the eccentric mounting, allows the spring end 17, also known as "spring tail", to be safely hooked onto the hooking slot 15 and be inserted into the collar 17 without scraping nor damaging the shaft 7. The eccentricity of the collar 19 with respect to the overhead shaft 7 is calculated based on several parameters such as capability of spring steel rod, tool to make spring tail, tolerance on spring diameters, etc. such as apparent to a person skilled in the art.

The present invention is an improvement and presents several advantages over other plugs known in the prior art, such as the one illustrated in FIGS. 2–4. For instance, by eccentrically mounting the collar 19 about the overhead shaft 7, the plug 1 according to the present invention can be used for when the space between the inside of the plug 1 and the shaft 7 is limited, either as a result of the shaft 7 being covered with an additional fitting (not shown) placed thereabout, or as a result of the plug 1 being used with torsion springs 9 having reduced inside diameters (preferably, torsion springs 9 having an inside diameter equal to or less than 2", which represent a major part of the market), or as a result of both. By eccentrically mounting the collar 19 about the overhead shaft 7, more clearance is allowed between me inside of the collar 19 and the shaft 7 so as to hook the spring's free end 17 onto the collar's slot 15 and lodge it between the inside of the plug 1 (or the inside of the collar 19 for that matter) and the shaft 7. The present invention can also be used with torsion springs 9 having different sizes of inside diameter, whether greater or smaller than the aforementioned. The present invention allows the free ends 17 of the torsion springs 9 (also known as "spring tails") to be hooked onto the slots 15 of the plugs 1, easily, quickly, safely, and reliably, without any special tooling, so that the spring tails 17 can be safely inserted into the collars 19 without scrapping the overhead shaft 7. Conversely, the present invention allows the same spring tails 17 to be hooked off the slots 15 of the plugs 1, with the same above-described advantages, for each maintenance and/or repair to the counterbalancing mechanism 3. The present invention may be used in the garage door industry, with counterbalancing mechanisms of new garage doors 5 or existing garage doors 5. As it is evident from reading the above description, the present invention is a more compact, more reliable, easier to use, easier to maintain, safer, quicker and more cost effective plug 1 than those available in the prior art. Furthermore, the present invention may be used with other kinds of doors 5, such as slidable truck doors, or with any other items suspended by a cable 11, as apparent to a person skilled in the art.

Of course, numerous modifications could be made to the above described embodiments without departing the scope of the invention as defined in the appended claims.

What is claimed is:

1. A plug for a counterbalancing mechanism of a cable-operated door, the counterbalancing mechanism including an overhead shaft and a torsion spring co-axially mounted onto said shaft, the plug being used for operatively connecting the overhead shaft to the torsion spring, the plug comprising:

a cylindrical collar having opposite first and second portions, the first portion being used for receiving a coiled segment of the torsion spring, the collar being provided with a hooking slot positioned between the first portion and the second portion of the collar for hooking a free end of the torsion spring into said hooking slot; and a cylindrical flange rigidly affixed to the second portion of the collar, said flange being used for transferring a torque between the torsion spring and the overhead shaft when the flange is securely fixed about the overhead shaft;

wherein the collar of the plug is eccentrically positioned with respect to the flange so as to allow a portion of the free end of the torsion spring to be lodged between the collar and the overhead shaft.

2. A plug according to claim 1, wherein the collar and the flange are made integral.

3. A plug according to the claim 1, wherein the plug is adapted to be removable fixed to the overhead shaft with setscrews.

4. A plug according to claim 3, wherein the flange of the plug is provided with at least one socket for receiving a winding bar in order to manually preset a given torque onto the torsion spring prior to securing the plug onto the overhead shaft.

5. A plug according to claim 4, wherein the plug is a winding plug.

6. A plug according to claim 5, wherein the collar and the flange are made integral.

7. A plug according to claim 3, wherein the hooking slot is substantially T-shaped.

8. A plug according to claim 1, wherein the hooking slot is substantially T-shaped.

9. A plug according to claim 1, wherein the plug is a winding plug adapted to be removably fixed to the overhead shaft by setscrews, the flange of the plug is provided with at least one socket for receiving a winding bar in order to manually preset a given torque onto the torsion spring prior to securing the plug onto the overhead shaft, the collar and the flange are made integral to each other, and the hooking slot is substantially T-shaped.

10. A plug according to claim 1, wherein the plug is a stationary plug.

11. A plug according to claim 10, wherein the hooking slot is substantially T-shaped.

12. A plug according to claim 1, wherein the plug is adapted to be removably connected to a fixed structure.

13. A plug according to claim 12, wherein the collar and the flange are made integral.

14. A plug according to claim 1, wherein the plug is a stationary plug adapted to be removably connected to a bracket rigidly mounted to a wall supporting the counterbalancing mechanism of the cable-operated door, the collar and the flange are made integral to each other, and the hooking slot is substantially T-shaped.

15. A plug for a counterbalancing mechanism of a cable-operated door, the counterbalancing mechanism including an overhead shaft and a torsion spring co-axially mounted onto said shaft, the plug being used for operatively connecting the overhead shaft to the torsion spring, the plug comprising:

a collar having opposite first and second portions, the first portion being used for receiving a coiled segment of the torsion spring, the collar being provided with a hooking slot positioned between the first portion and the second portion of the collar for hooking a free end of the torsion spring into said hooking slot; and a flange rigidly affixed to the second portion of the collar, said flange being used for transferring a torque between the torsion spring and the overhead shaft when the flange is securely fixed about the overhead shaft;

wherein the collar of the plug is eccentrically positioned with respect to the flange so as to allow a portion of the free end of the torsion spring to be lodged between the collar and the overhead shaft.

* * * * *